US009749746B2

(12) United States Patent
Lu

(10) Patent No.: US 9,749,746 B2
(45) Date of Patent: Aug. 29, 2017

(54) DEVICES AND METHODS FOR REDUCING THE PROCESSING TIME OF THE CONVERGENCE OF A SPATIAL FILTER

(71) Applicant: Fortemedia, Inc., Santa Clara, CA (US)

(72) Inventor: Yan-Chen Lu, Santa Clara, CA (US)

(73) Assignee: FORTEMEDIA, INC., Santa Clara, CA (US)

( * ) Notice: Subject to any disclaimer, the term of this patent is extended or adjusted under 35 U.S.C. 154(b) by 0 days.

(21) Appl. No.: 15/131,320

(22) Filed: Apr. 18, 2016

(65) Prior Publication Data

US 2016/0322063 A1 Nov. 3, 2016

Related U.S. Application Data

(60) Provisional application No. 62/154,353, filed on Apr. 29, 2015.

(51) Int. Cl.
*H04R 3/04* (2006.01)
*G10L 21/00* (2013.01)

(52) U.S. Cl.
CPC ..... *H04R 3/04* (2013.01); *G10L 21/00* (2013.01); *H04R 2227/001* (2013.01)

(58) Field of Classification Search
CPC ..... G10L 21/0208; G10L 2021/02082; G10L 2021/02085; G10L 25/27; H04N 5/357; H04N 5/21; H04R 1/1083; H04R 3/002; H04R 1/1041; H04R 29/00; H04R 3/04; H04R 2410/05; H04R 2460/01; H04R 25/453; H04R 3/02; H04R 2225/43; H04R 25/30; H04R 25/70; H04R 25/45; H04R 1/1016; H04R 2205/041; H04R 2225/025; H04R 2225/41; H04R 2225/61; H04R 2410/03; G05B 13/048
See application file for complete search history.

(56) References Cited

U.S. PATENT DOCUMENTS 4,811,360 A * 3/1989 Potter ..... H04L 25/03038 333/18
5,754,660 A * 5/1998 Shimizu ..... A63F 13/02 381/17
6,107,963 A * 8/2000 Ohmi ..... H01Q 3/2605 342/378

(Continued)

FOREIGN PATENT DOCUMENTS

EP 0736995 A2 * 10/1996 ..... H04B 3/23

*Primary Examiner* — Mohammad Islam
(74) *Attorney, Agent, or Firm* — McClure, Qualey & Rodack, LLP

(57) ABSTRACT

A noise-suppression device includes an input buffer, a spatial filter, a delay buffer, and a controller. The input buffer stores sound data. The spatial filter generates processed data by using an internal adaptive control according to a control signal. The delay buffer stores the processed data. The controller operates in either one of a training stage, a flushing stage, or a normal stage and generates the control signal. When the controller operates in the training stage, the spatial filter receives the sound data from the input buffer to generate the processed data which is continuously processed by the spatial filter and then stored in the delay buffer over and over again until the internal adaptive control is converged.

12 Claims, 6 Drawing Sheets

300

(56) References Cited

U.S. PATENT DOCUMENTS 6,480,532 B1 * 11/2002 Vareljian ..... H04B 3/23 375/217
6,810,273 B1 * 10/2004 Mattila ..... G10L 21/0208 370/286
6,947,553 B2 * 9/2005 Koyama ..... H04B 3/23 379/406.01
7,321,857 B2 * 1/2008 Rodriguez ..... G06F 17/2735 704/228
8,861,109 B1 * 10/2014 Hwang ..... G11B 20/10305 360/31
8,942,248 B1 * 1/2015 Cheung ..... H04L 7/0041 370/412
2002/0181567 A1 * 12/2002 Hamdi ..... H04B 1/1027 375/222
2003/0123674 A1 * 7/2003 Boland ..... H04M 9/082 381/66
2005/0220043 A1 * 10/2005 Handel ..... H04B 3/23 370/286
2008/0130907 A1 * 6/2008 Sudo ..... G10L 21/0208 381/66
2009/0299752 A1 * 12/2009 Rodriguez ..... D06F 58/28 704/275
2012/0177223 A1 * 7/2012 Kanamori ..... G10L 21/0208 381/94.7
2012/0210191 A1 * 8/2012 Tokoro ..... H03M 13/253 714/756
2013/0222290 A1 * 8/2013 Choi ..... G06F 3/041 345/173
2014/0064422 A1 * 3/2014 Zhang ..... H04L 7/0083 375/371
2015/0071454 A1 * 3/2015 Sunohara ..... H04R 25/453 381/71.11
2015/0073787 A1 * 3/2015 Wang ..... G10L 21/0208 704/233
2015/0245155 A1 * 8/2015 Root ..... H04R 29/004 381/66
2015/0255085 A1 * 9/2015 Yamabe ..... G10L 21/0208 704/226

* cited by examiner

DEVICES AND METHODS FOR REDUCING THE PROCESSING TIME OF THE CONVERGENCE OF A SPATIAL FILTER

CROSS REFERENCE TO RELATED APPLICATIONS

This application claims the benefit of U.S. Provisional Application No. 62/154,353, filed on Apr. 29, 2015, the entirety of which is incorporated by reference herein.

BACKGROUND OF THE INVENTION

Field of the Invention

The disclosure relates generally to methods and devices for reducing the processing time for a spatial filter to arrive at its steady state.

Description of the Related Art

Spatial filters work based on an adaptive control module used for tackling problems that arise in changing acoustic surroundings. A noise-suppression function is performed by the spatial filter once the internal adaptive control of the spatial filter reaches a steady state (i.e., converged). However, it may take a substantial amount of time for the internal adaptive control of a spatial filter to converge, and this may result in the poor performance of the spatial filter. Therefore, methods and devices for speeding up the convergence of a spatial filter are required.

BRIEF SUMMARY OF THE INVENTION

For solving the problems described above, the invention provides a noise-suppression device and method for utilizing idle computation power and output buffer memory during a delay time to speed up the convergence of a spatial filter's internal adaptive control.

In an embodiment, a noise-suppression device includes an input buffer, a spatial filter, a delay buffer, and a controller. The input buffer stores sound data. The spatial filter generates processed data by using an internal adaptive control according to a control signal. The delay buffer stores the processed data. The controller operates in either one of a training stage, a flushing stage, or a normal stage and generates the control signal. When the controller operates in the training stage, the spatial filter receives the sound data from the input buffer to generate the processed data which is continuously processed by the spatial filter and then stored in the delay buffer over and over again until the internal adaptive control is converged.

According to an embodiment of the invention, the noise-suppression device further includes an output buffer receiving and storing output data. The spatial filter generates the output data when the internal adaptive control is converged.

According to an embodiment of the invention, the delay buffer shares a part of the output buffer.

According to an embodiment of the invention, the noise-suppression device further includes a buffer control module configured to generate a read address and a write address of the delay buffer for avoiding a data conflict between the output buffer and the delay buffer and arranging the memory allocation when the delay buffer and the output buffer are different sizes. The spatial filter processes the processed data stored in the delay buffer according to the read address and then writes the processed data to the delay buffer according to the write address.

According to an embodiment of the invention, once the controller determines that the internal adaptive control is converged, the controller stops operating in the training stage and then operates in the flushing stage.

According to an embodiment of the invention, when the controller operates in the flushing stage, the spatial filter processes the processed data stored in the delay buffer to generate the output data, and meanwhile the sound data of the input buffer is written to the delay buffer without being processed by the spatial filter.

According to an embodiment of the invention, the delay buffer shares a part of the output buffer.

According to an embodiment of the invention, the noise-suppression device further includes a buffer control module configured to generate a read address and a write address of the delay buffer for avoiding a data conflict between the output buffer and the delay buffer and arranging the memory allocation when the delay buffer and the output buffer are different sizes. The spatial filter processes the processed data stored in the delay buffer according to the read address, and meanwhile the sound data of the input buffer is written to the delay buffer according to the write address.

According to an embodiment of the invention, once the controller determines that the delay buffer is empty, the controller stops operating in the flushing stage and then operates in the normal stage.

According to an embodiment of the invention, when the controller operates in the normal stage, the spatial filter processes the sound data stored in the input buffer to generate the output data, wherein the output data is stored in the output buffer.

In an embodiment, a noise-suppression method adapted to a noise-suppression device including an input buffer, a spatial filter, and a delay buffer which includes: operating the noise-suppression device a training stage; processing, by the spatial filter using an internal adaptive control, sound data of the input buffer to generate processed data; storing the processed data in the delay buffer; determining whether the internal adaptive control is converged; and continuously processing, by the spatial filter, the processed data stored in the delay buffer and then writing the processed data to the delay buffer over and over again until the internal adaptive control is converged.

According to an embodiment of the invention, the noise-suppression method further includes: when the internal adaptive control is converged, receiving and storing, by an output buffer, output data generated by the spatial filter.

According to an embodiment of the invention, the delay buffer shares a part of the output buffer.

According to an embodiment of the invention, the noise-suppression method further includes: generating, by a buffer control module, a read address and a write address of the delay buffer for avoiding a data conflict between the output buffer and the delay buffer and arranging the memory allocation when the delay buffer and the output buffer are different sizes. The processed data stored in the delay buffer is processed by the spatial filter according to the read address and then is written to the delay buffer according to the write address.

According to an embodiment of the invention, the noise-suppression method further includes: once the internal adaptive control is converged, stopping the operation of the noise-suppression device in the training stage; and operating the noise-suppression device in a flushing stage.

According to an embodiment of the invention, the noise-suppression method further includes: processing, by the spatial filter, the processed data stored in the delay buffer to generate the output data when operating the noise-suppression device in the flushing stage; meanwhile, writing the sound data of the input buffer to the delay buffer without being processed by the spatial filter; and determining whether the delay buffer is empty.

According to an embodiment of the invention, the delay buffer shares a part of the output buffer.

According to an embodiment of the invention, the noise-suppression method further includes: generating, by a buffer control module, a read address and a write address of the delay buffer for avoiding a data conflict between the output buffer and the delay buffer and arranging the memory allocation when the delay buffer and the output buffer are different sizes. The processed data stored in the delay buffer is processed by the spatial filter according to the read address, and meanwhile the sound data of the input buffer is written to the delay buffer according to the write address.

According to an embodiment of the invention, the noise-suppression method further includes: once the delay buffer is empty, stopping the operation of the noise-suppression device in the flushing stage; and operating the noise-suppression device in the normal stage.

According to an embodiment of the invention, the noise-suppression method further includes: when operating the noise-suppression device in the normal stage, processing, by the spatial filter, the sound data of the input buffer to generate the output data, wherein the output data is stored in the output buffer.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
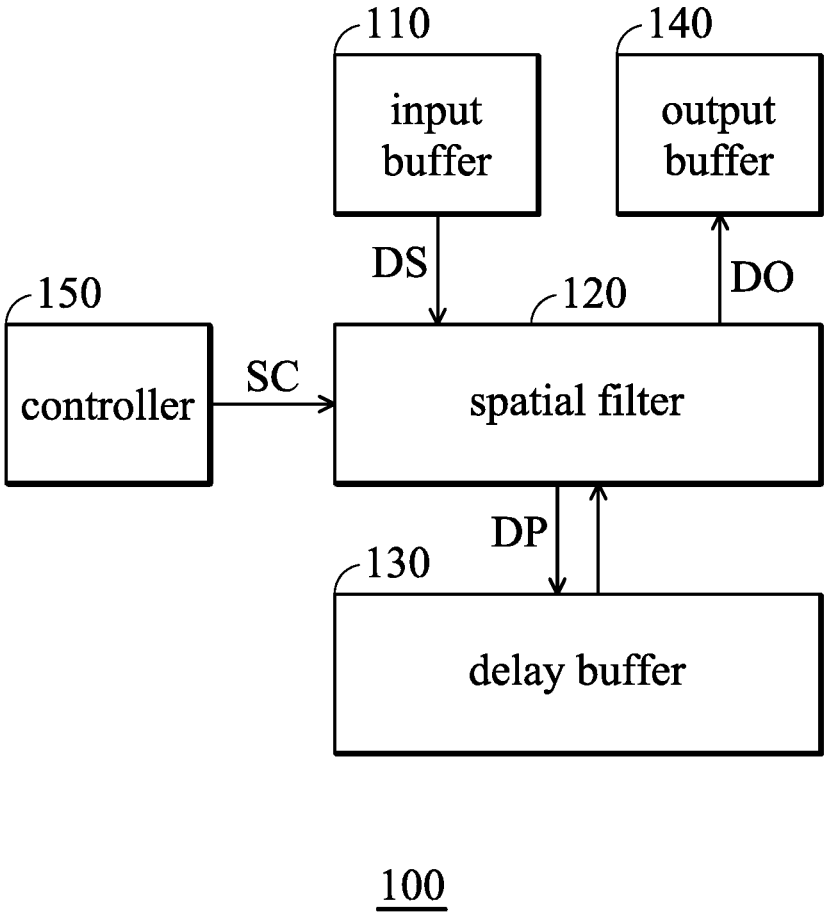
FIG. 1 is a block diagram of the noise-suppression device in accordance with an embodiment of the invention.

FIG. 1 is a block diagram of the noise-suppression device in accordance with an embodiment of the invention. As shown in FIG. 1, the noise-suppression device 100 includes the input buffer 110, the spatial filter 120, the delay buffer 130, the output buffer 140, and the controller 150. The input buffer stores the sound data DS and feeds the sound data DS to the spatial filter 120.

When the spatial filter 120 receives the sound data DS, the spatial filter processes the sound data DS to generate the processed data DP or the output data DO according to the control signal SC. When the controller 150 operates in the training stage, the flushing stage, or the normal stage, the controller 150 generates the respective control signal SC to control the spatial filter 120 to execute the proper actions. Each of the training stage, the flushing stage, and the normal stage will be described in detail in the following description.

The delay buffer 130 is configured to store the processed data DP when the spatial filter 120 is not converged yet. The output buffer 140 is configured to store the output data DO generated by the converged spatial filter 120. According to an embodiment of the invention, the delay buffer 130 and the output buffer 140 may be two different memory devices, so that the delay buffer 130 and the output buffer 140 each has their individual memory space. According to another embodiment of the invention, the delay buffer 130 shares a part of the memory space of the output buffer 140, and the delay buffer 130 will be expelled back to the output buffer 140 after the spatial filter 120 is converged.

Figure 2:
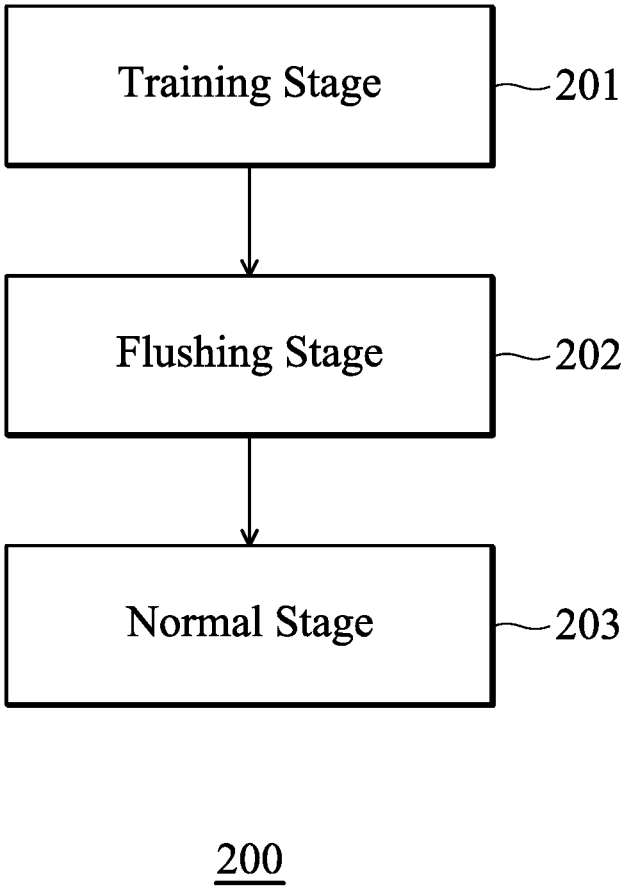
FIG. 2 is a flow chart of the workflow of the controller in accordance with an embodiment of the invention.

FIG. 2 is a flow chart of the workflow of the controller in accordance with an embodiment of the invention. As shown in FIG. 2, the workflow 200 illustrates that the controller 150 in FIG. 1 operates in the training stage 201, the flushing stage 202, and the normal stage 203 accordingly. Once the noise-suppression device 100 is turned ON, the controller 150 operates in the training stage 201 and the flushing stage 202 to speed up the convergence of the internal adaptive control of the spatial filter 120.

Once the internal adaptive control of the spatial filter 120 is converged, the controller 150 operates in the normal stage 203, and the converged spatial filter 120 receives the sound data DS from the input buffer to generate the output data DO to the output buffer 140. The detailed actions of each of the training stage 201, the flushing stage 202, and the normal stage 203 are illustrated in the following description.

Figure 3:
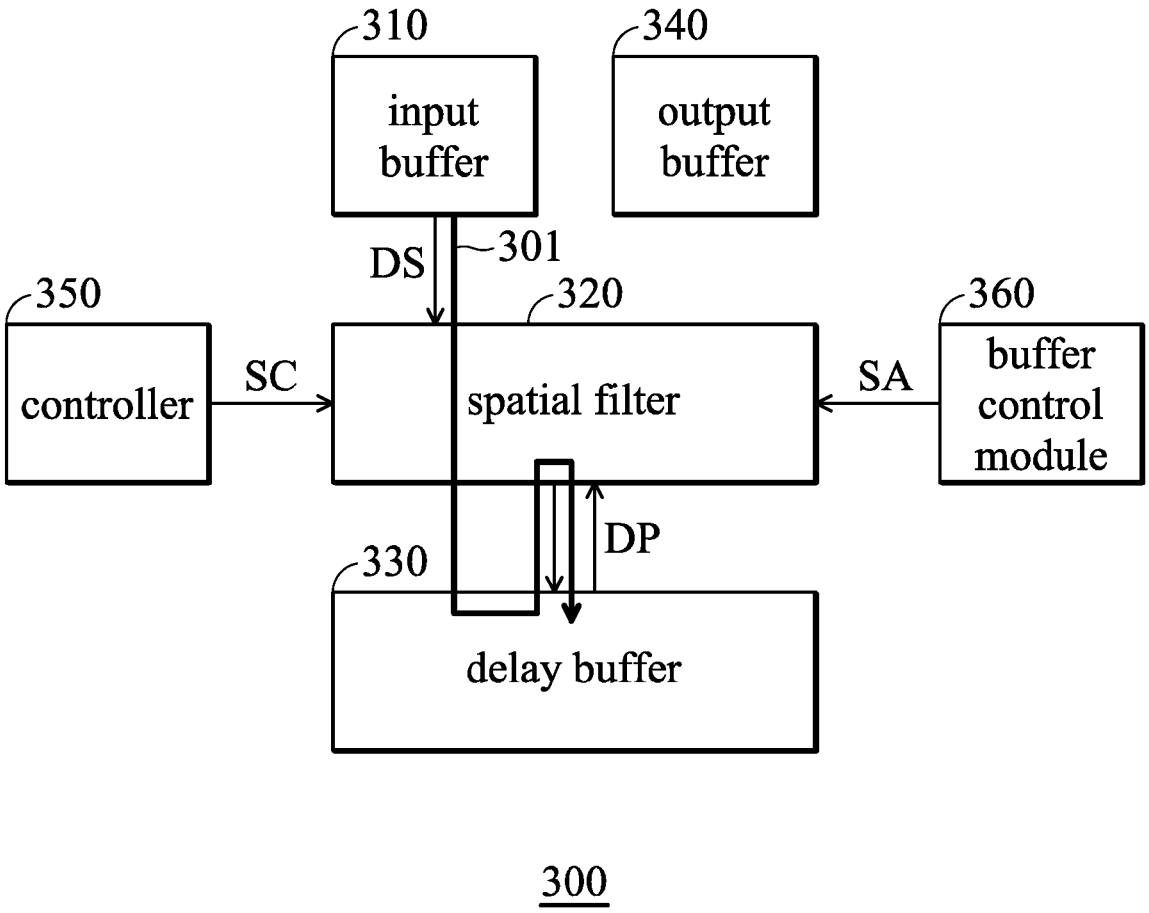
FIG. 3 shows a schematic diagram of the noise-suppression device operating in the training stage in accordance with an embodiment of the invention.

FIG. 3 shows a schematic diagram of the noise-suppression device operating in the training stage in accordance with an embodiment of the invention. As illustrated by the signal flow 301, when the controller 350 operates in the training stage 201, the spatial filter 320 receives the sound data DS to generate the processed data DP according to the control signal SC generated by the controller 350, in which the processed data DP is stored in the delay buffer 330.

According to an embodiment of the invention, when the controller 350 operates in the training stage 201 in FIG. 2, the spatial filter 320 may process the sound data DS more than once and then store the processed data DP in the delay buffer 330 (as illustrated by the signal flow 301) to speed up the convergence of the internal adaptive control. In other words, after receiving the sound data DS to generate the processed data DP, the controller 350 further determines whether the internal adaptive control of the spatial filter 320 is converged.

When the controller 350 determines that the internal adaptive control is not converged, the spatial filter 320 processes the processed data DP stored in the delay buffer 330 and then stores the processed data DP in the delay buffer 330 over and over again until the internal adaptive control of the spatial filter 320 is converged. Then, the controller 350 determines whether the internal adaptive control is converged one more time. Namely, if the internal adaptive control is not converged yet, the spatial filter 320 would keep processing the processed data DP stored in the delay buffer 330 and then storing the processed data DP back to the delay buffer 330 over and over again, as illustrated by the signal flow 301. Once the controller 350 determines that the internal adaptive control of the delay buffer 330 is converged, the delay buffer 330 stops processing the processed data DP.

According to an embodiment of the invention, the delay buffer 330 and the output buffer 340 are two different memory devices, so that the delay buffer 330 and the output buffer 340 each has their individual memory space. Therefore, the controller 350 controls the spatial filter 320 to store the processed data DP in the delay buffer 330.

According to another embodiment of the invention, the delay buffer 330 shares a part of the memory space of the output buffer 340. The noise-suppression device 300 further includes the buffer control module 360 for avoiding a data conflict between the output buffer and the delay buffer and arranging the memory allocation when the delay buffer 330 and the output buffer 340 are different sizes.

The buffer control module 360 is configured to divide a part of the memory space of the output buffer 340 to be the delay buffer 330 and to provide the address signal SA for the spatial filter 320, in which the address signal SA includes a read address and a write address. When the controller 350 operates in the training stage 201, the spatial filter processes the processed data DP stored in the delay buffer 330 according to the read address of the address signal SA, and then writes the processed data DP to the delay buffer 330 according to the write address of the address signal SA.

Figure 4:
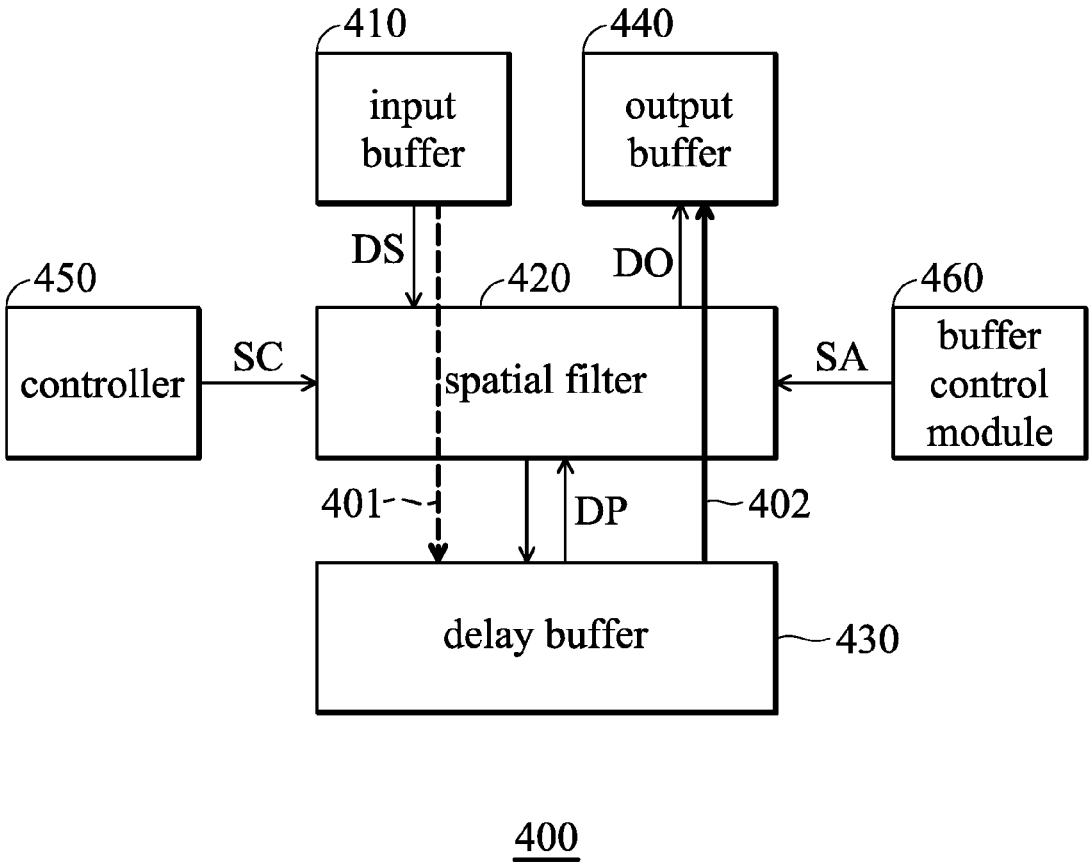
FIG. 4 shows a schematic diagram of the noise-suppression device operating in the flushing stage in accordance with an embodiment of the invention.

FIG. 4 shows a schematic diagram of the noise-suppression device operating in the flushing stage in accordance with an embodiment of the invention. Once the controller 450 determines that the internal adaptive control of the spatial filter 420 is converged, the controller 450 stops operating in the training stage 201 and then operates in the flushing stage 202. When the controller 450 operates in the flushing stage 202 in FIG. 2, the converged spatial filter 420 processes the processed data DP stored in the delay buffer 430 to generate the output data DO as illustrated by the first signal flow 401. Meanwhile, the sound data DS of the input buffer 410 is written to the delay buffer 430 without being processed by the converged spatial filter 420 as illustrated by the second signal flow 402.

According to another embodiment of the invention, the delay buffer 430 shares a part of the memory space of the output buffer 440. Therefore, the speed of the spatial filter 420 processing the processed data DP in the delay buffer 430 is faster than that of processing the sound data DS from the input buffer 410, since the memory space of the delay buffer 430 is freed up and returned to the output buffer 440. According to an embodiment of the invention, the flushing stage 202 is terminated when the controller 450 determines that the delay buffer 430 is empty. In other words, once the delay buffer 430 is empty, the memory space of the delay buffer 430 is expelled back to the output buffer 440 and the controller 450 then operates in the normal stage 203.

Figure 5:
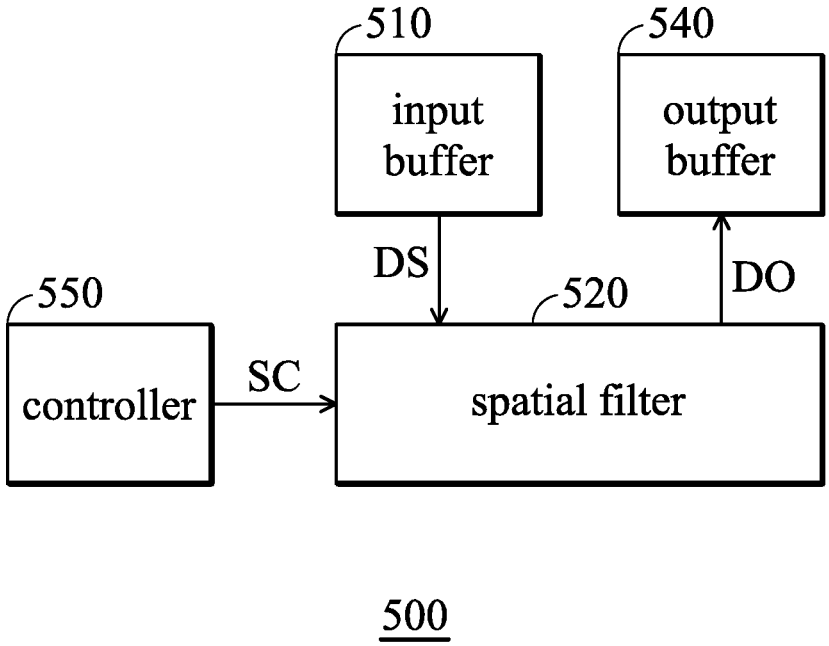
FIG. 5 shows a schematic diagram of the noise-suppression device operating in the normal stage in accordance with an embodiment of the invention.

FIG. 5 shows a schematic diagram of the noise-suppression device operating in the normal stage in accordance with an embodiment of the invention. As shown in FIG. 5, when the controller 550 operates in the normal stage 203, the converged spatial filter 520 processes the sound data DS from the input buffer 510 to generate the output data DO to the output buffer 540 according to the control signal SC. In other words, the delay buffer 330 and 430 and the buffer control module 360 and 460 are only configured to speed up the convergence of the internal adaptive control of the spatial filter 120, which are no more necessary in the normal stage 203.

Figure 6:
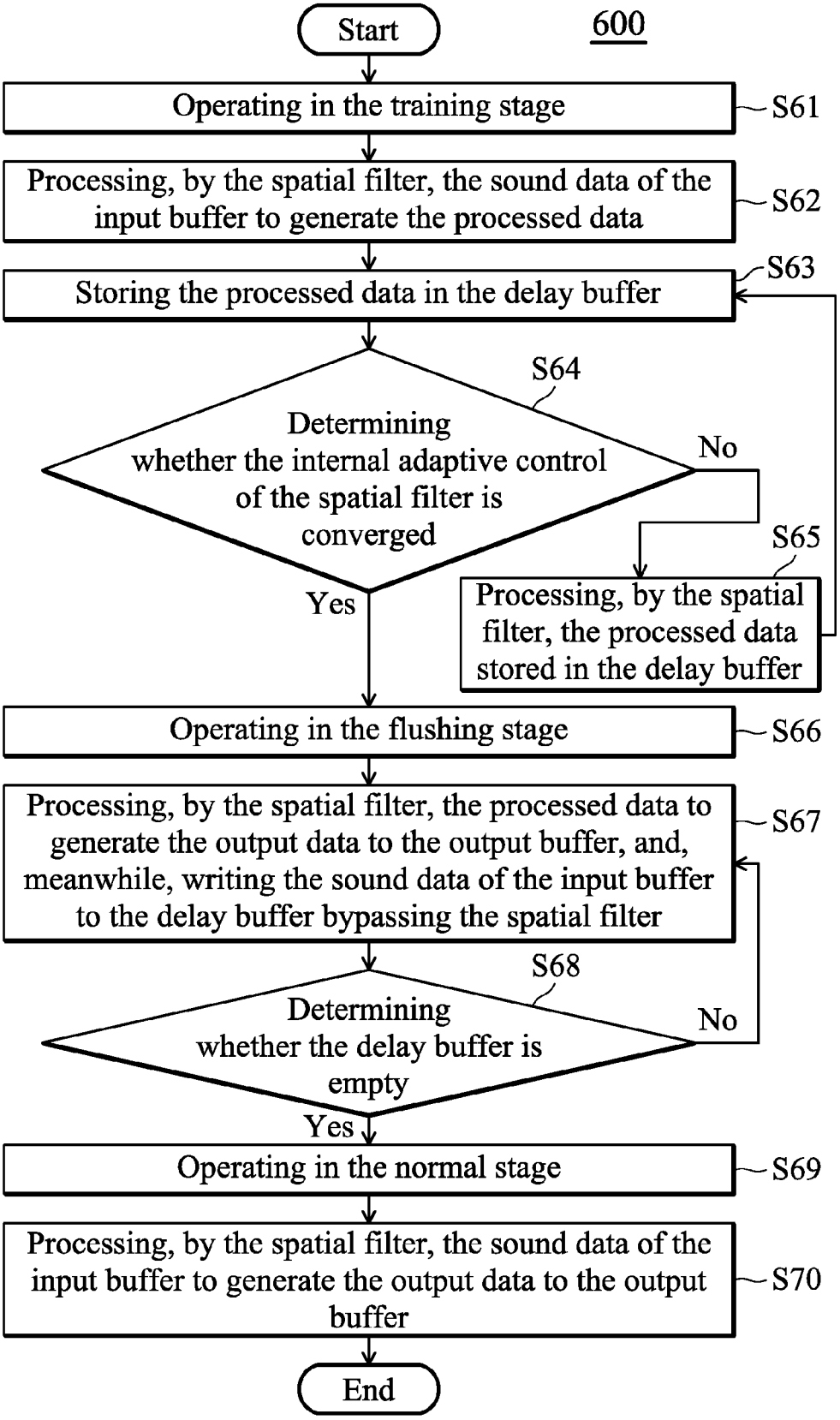
FIG. 6 shows a flow chart of the noise-suppression method in accordance with an embodiment of the invention.

FIG. 6 shows a flow chart of the noise-suppression method in accordance with an embodiment of the invention. For the sake of clarity, FIG. 6 will be described with FIGS. 3-5 in the following description. As shown in FIG. 6, the controller 350 in FIG. 3 operates in the training stage 201 (Step S61). When the controller 350 operates in the training stage 201, the spatial filter 320 processes the sound data DS of the input buffer 310 to generate the processed data DP (Step S62), and the processed data DP is stored in the delay buffer 330 (Step S63) as illustrated by the signal flow 301.

The controller 350 then determines whether the internal adaptive control of the spatial filter 320 is converged (Step S64). When the spatial filter 320 is not converged, the spatial filter 320 processes the processed data DP stored in the delay buffer 330 (Step S65), and the noise-suppression method 600 goes back to Step S63. Namely, the spatial filter 320 would keep processing the processed data DP stored in the delay buffer 330 and then storing the processed data DP back to the delay buffer 330 over and over again, as illustrated by the signal flow 301. On the other hand, when the spatial filter 320 is converged, the controller 350 stops the operation of the training stage 201 and operates in the flushing stage 202 (Step S66).

When the controller 450 in FIG. 4 operates in the flushing stage 202, the spatial filter 420 processes the processed data DP of the delay buffer 430 to generate the output data DO to the output buffer 440 as illustrated by the second signal flow 402, and meanwhile the sound data DS of the input buffer 410 is written to the delay buffer 430, bypassing the spatial filter 420 as illustrated by the first signal flow (Step S67). The controller 450 determines whether the delay buffer 430 is empty (Step S68).

When the delay buffer 430 is not empty, the noise-suppression method 600 goes back to Step S67. When the delay buffer 430 is empty, the controller 450 operates in the normal stage 203 (Step S69). When the controller 550 operates in the normal stage 203, the spatial filter processes the sound data DS of the input buffer 510 to generate the output data DO to the output buffer 440 (Step 70). Therefore, the speed of the internal adaptive control of the spatial filter reaching the convergence is greatly improved by the devices and methods proposed in the invention.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A noise-suppression device, comprising:

an input buffer, storing sound data;

a spatial filter, generating processed data by using an internal adaptive control according to a control signal;

a delay buffer, storing the processed data;

a controller, operating in either one of a training stage, a flushing stage, or a normal stage and generating the control signal, wherein when the controller operates in the training stage, the spatial filter receives the sound data from the input buffer to generate the processed data, wherein the processed data is continuously processed by the spatial filter and then stored in the delay buffer over and over again until the internal adaptive control is converged; and a buffer control module, configured to divide a part of memory space of the output buffer to be the delay buffer to generate a read address and a write address of the delay buffer for avoiding a data conflict between the output buffer and the delay buffer and for arranging the memory allocation when the delay buffer and the output buffer are different sizes, wherein the spatial filter processes the processed data stored in the delay buffer according to the read address and then writes the processed data to the delay buffer according to the write address.

2. The noise-suppression device in claim 1, further comprising:

an output buffer, receiving and storing output data, wherein the spatial filter generates the output data when the internal adaptive control is converged.

3. The noise-suppression device in claim 2, wherein once the controller determines that the internal adaptive control is converged, the controller stops operating in the training stage and then operates in the flushing stage.

4. The noise-suppression device in claim 3, wherein when the controller operates in the flushing stage, the spatial filter processes the processed data stored in the delay buffer to generate the output data, and meanwhile the sound data of the input buffer is written to the delay buffer without being processed by the spatial filter.

5. The noise-suppression device in claim 3, wherein once the controller determines that the delay buffer is empty, the controller stops operating in the flushing stage and then operates in the normal stage.

6. The noise-suppression device in claim 5, wherein when the controller operates in the normal stage, the spatial filter processes the sound data stored in the input buffer to generate the output data, wherein the output data is stored in the output buffer.

7. A noise-suppression method adapted to a noise-suppression device comprising an input buffer, a spatial filter, and a delay buffer, the noise method comprising:

operating the noise-suppression device in a training stage;

processing, by the spatial filter using an internal adaptive control, sound data of the input buffer to generate processed data;

dividing, by a buffer control module, a part of memory space of the output buffer to be the delay buffer to generate a read address and a write address of the delay buffer for avoiding a data conflict between the output buffer and the delay buffer and for arranging the memory allocation when the delay buffer and the output buffer are different sizes;

storing the processed data in the delay buffer;

determining whether the internal adaptive control is converged; and continuously processing, by the spatial filter, the processed data stored in the delay buffer and then writing the processed data to the delay buffer over and over again until the internal adaptive control is converged, wherein the processed data stored in the delay buffer is processed by the spatial filter according to the read address and then is written to the delay buffer according to the write address.

8. The noise-suppression method in claim 7, further comprising:

when the internal adaptive control is converged, receiving and storing, by an output buffer, output data generated by the spatial filter.

9. The noise-suppression method in claim 8, further comprising:

once the internal adaptive control is converged, stopping the operation of the noise-suppression device in the training stage; and operating the noise-suppression device in a flushing stage.

10. The noise-suppression method in claim 9, further comprising:

processing, by the spatial filter, the processed data stored in the delay buffer to generate the output data when operating the noise-suppression device in the flushing stage;

meanwhile, writing the sound data of the input buffer to the delay buffer without being processed by the spatial filter; and determining whether the delay buffer is empty.

11. The noise-suppression method in claim 9, further comprising:

once the delay buffer is empty, stopping the operation of the noise-suppression device in the flushing stage; and operating the noise-suppression device in the normal stage.

12. The noise-suppression method in claim 11, further comprising:

when operating the noise-suppression device in the normal stage, processing, by the spatial filter, the sound data of the input buffer to generate the output data, wherein the output data is stored in the output buffer.

* * * * *